US006412236B1

(12) United States Patent
Johnson

(10) Patent No.: US 6,412,236 B1
(45) Date of Patent: Jul. 2, 2002

(54) EASILY INSTALLABLE FENCE POST

(76) Inventor: Jeff Johnson, P.O. Box #4, Camden, TX (US) 75934

( * ) Notice: Subject to any disclaimer, the term of this patent is extended or adjusted under 35 U.S.C. 154(b) by 0 days.

(21) Appl. No.: 09/727,413

(22) Filed: Dec. 1, 2000

(51) Int. Cl.[7] ..... E04H 17/20

(52) U.S. Cl. ..... 52/165; 52/157; 52/169.13; 256/32; 256/DIG. 5

(58) Field of Search ..... 52/155, 156, 157, 52/165, 169.13, 705, DIG. 11; 256/32, 47, 64, DIG. 5

(56) References Cited

U.S. PATENT DOCUMENTS

| | | | | | |
|---|---|---|---|---|---|
| 200,217 | A | * | 2/1878 | Mudgett | 256/58 |
| 303,263 | A | * | 8/1884 | Burton | 52/157 |
| 314,870 | A | * | 3/1885 | Nendel et al. | 256/56 |
| 361,001 | A | * | 4/1887 | Devens | 52/165 |
| 495,471 | A | * | 4/1893 | Brown | 52/153 |
| 575,374 | A | * | 1/1897 | Reck | 52/153 |
| 598,003 | A | * | 1/1898 | Oliver | 52/154 |
| 624,724 | A | * | 5/1899 | Alter | 52/156 |
| 795,405 | A | * | 7/1905 | Moore | 52/157 |
| 832,565 | A | * | 10/1906 | Wilson | 52/157 |
| 1,030,411 | A | * | 6/1912 | Larsen | 256/32 |
| 1,049,549 | A | * | 1/1913 | Tesreau et al. | 256/54 |
| 1,562,343 | A | * | 11/1925 | Bore | 52/157 |
| 2,084,239 | A | * | 6/1937 | Bradford | 52/156 |
| 3,293,809 | A | | 12/1966 | Daline | |
| 3,698,144 | A | | 10/1972 | Stratton | |
| 4,280,768 | A | * | 7/1981 | Pardue, Jr. et al. | 52/157 X |
| 4,595,176 | A | * | 6/1986 | Crabtree | 256/52 |
| 4,863,137 | A | | 9/1989 | Cockman et al. | |
| D314,328 | S | | 2/1991 | Cobb | |
| 5,613,329 | A | | 3/1997 | Land et al. | |
| 5,697,600 | A | * | 12/1997 | Fingerson et al. | 256/64 |
| 5,934,836 | A | | 8/1999 | Rupiper et al. | |
| 6,050,740 | A | * | 4/2000 | Dziedzic | 52/157 X |

FOREIGN PATENT DOCUMENTS

| | | | | |
|---|---|---|---|---|
| GB | 21767 | * | 10/1902 | 52/157 |
| GB | 134301 | * | 10/1919 | 52/157 |
| WO | WO 86/01849 | * | 3/1986 | 52/165 |

* cited by examiner

*Primary Examiner*—Beth A. Stephan
*Assistant Examiner*—Brian E. Glessner

(57) ABSTRACT

A easily installable fence post for fence posts. The easily installable fence post includes an elongated member having a first end and the second end. An auger bit portion for extending into a ground surface has a pointed end and a blunt end. The blunt end is integrally coupled to the first end of the elongated member such that the auger bit has a longitudinal axis is generally coaxial with a longitudinal axis of the elongated member.

4 Claims, 4 Drawing Sheets

EASILY INSTALLABLE FENCE POST

BACKGROUND OF THE INVENTION

1. Field of the Invention

The present invention relates to fence posts and more particularly pertains to a new easily installable fence post for fence posts.

2. Description of the Prior Art

The use of fence posts is known in the prior art. More specifically, fence posts heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 3,698,144; 3,293,809; 4,863,137; 5,934,836; 5,613,329; and Des. 314,328.

While these devices fulfill their respective, particular objectives and requirements, the aforementioned patents do not disclose a new easily installable fence post. The inventive device includes an elongated member having a first end and the second end. An auger bit portion for extending into a ground surface has a pointed end and a blunt end. The blunt end is integrally coupled to the first end of the elongated member such that the auger bit has a longitudinal axis is generally coaxial with a longitudinal axis of the elongated member.

In these respects, the easily installable fence post according to the present invention substantially departs from the conventional concepts and designs of the prior art, and in so doing provides an apparatus primarily developed for the purpose of fence posts.

SUMMARY OF THE INVENTION

In view of the foregoing disadvantages inherent in the known types of fence posts now present in the prior art, the present invention provides a new easily installable fence post construction wherein the same can be utilized for fence posts.

The general purpose of the present invention, which will be described subsequently in greater detail, is to provide a new easily installable fence post apparatus and method which has many of the advantages of the fence posts mentioned heretofore and many novel features that result in a new easily installable fence post which is not anticipated, rendered obvious, suggested, or even implied by any of the prior art fence posts, either alone or in any combination thereof.

To attain this, the present invention generally comprises an elongated member having a first end and the second end. An auger bit portion for extending into a ground surface has a pointed end and a blunt end. The blunt end is integrally coupled to the first end of the elongated member such that the auger bit has a longitudinal axis is generally coaxial with a longitudinal axis of the elongated member.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new easily installable fence post apparatus and method which has many of the advantages of the fence posts mentioned heretofore and many novel features that result in a new easily installable fence post which is not anticipated, rendered obvious, suggested, or even implied by any of the prior art fence posts, either alone or in any combination thereof.

It is another object of the present invention to provide a new easily installable fence post which may be easily and efficiently manufactured and marketed.

It is a further object of the present invention to provide a new easily installable fence post which is of a durable and reliable construction.

An even further object of the present invention is to provide a new easily installable fence post which is susceptible of a low cost of manufacture with regard to both materials and labor, and which accordingly is then susceptible of low prices of sale to the consuming public, thereby making such easily installable fence post economically available to the buying public.

Still yet another object of the present invention is to provide a new easily installable fence post which provides in the apparatuses and methods of the prior art some of the advantages thereof, while simultaneously overcoming some of the disadvantages normally associated therewith.

Still another object of the present invention is to provide a new easily installable fence post for fence posts.

Yet another object of the present invention is to provide a new easily installable fence post which includes an elongated member having a first end and the second end. An auger bit portion for extending into a ground surface has a pointed end and a blunt end. The blunt end is integrally coupled to the first end of the elongated member such that the auger bit has a longitudinal axis is generally coaxial with a longitudinal axis of the elongated member.

Still yet another object of the present invention is to provide a new easily installable fence post that drives fence post easily into a ground surface using gearboxes conventionally found on tractors.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
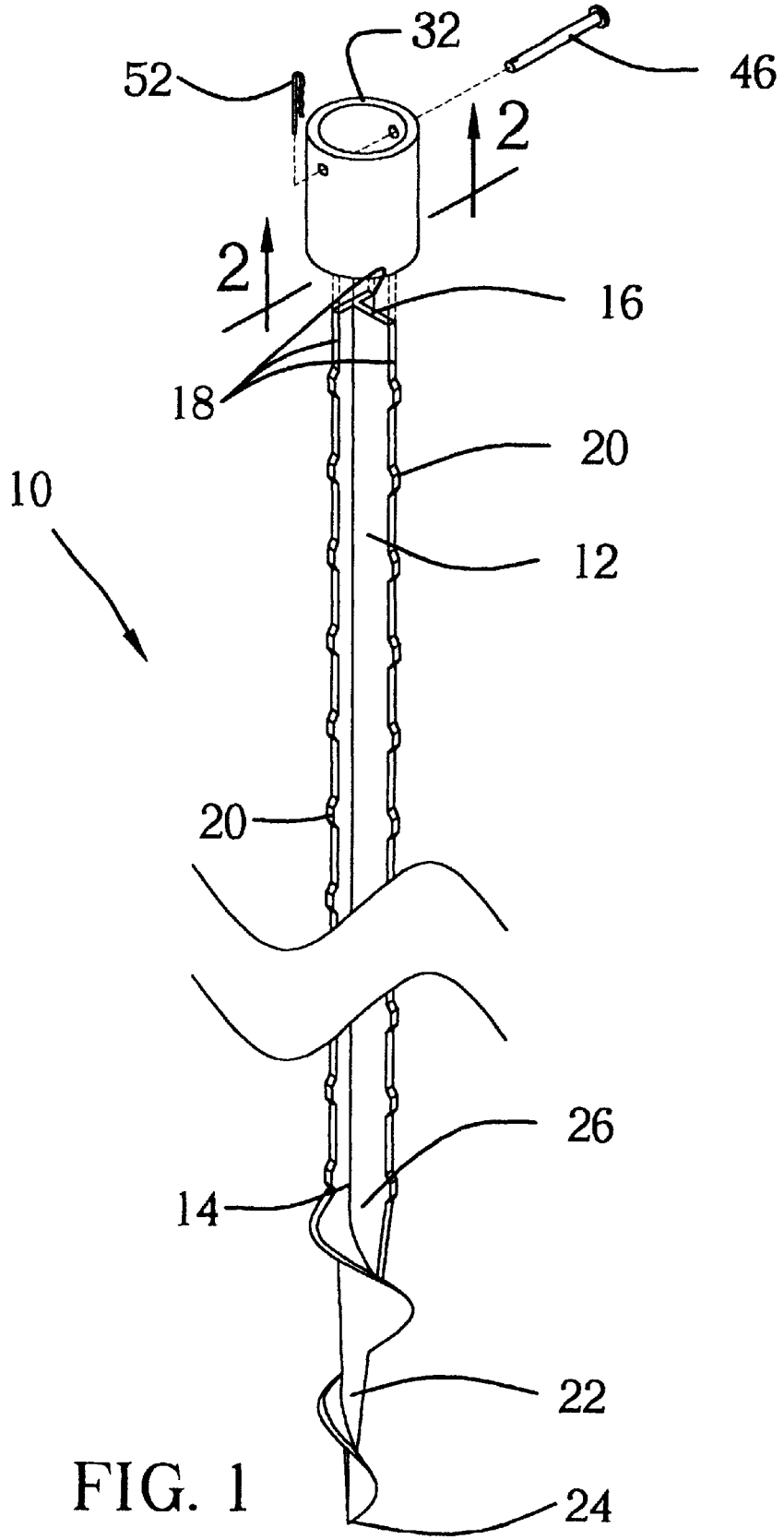
FIG. 1 is a schematic perspective view of a new easily installable fence post according to the present invention.
Figure 2:
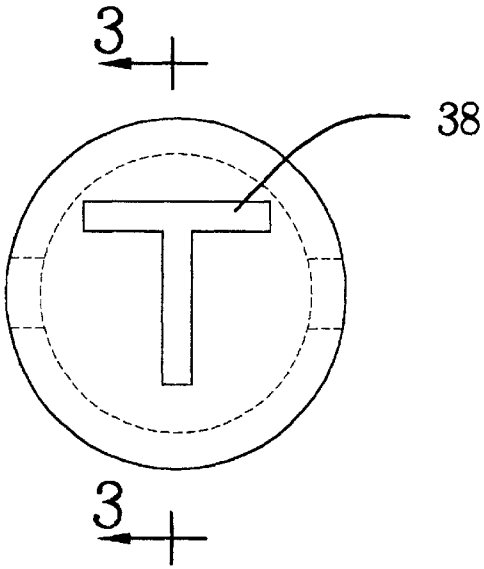
FIG. 2 is a schematic top view of the coupling member of the present invention.
Figure 3:
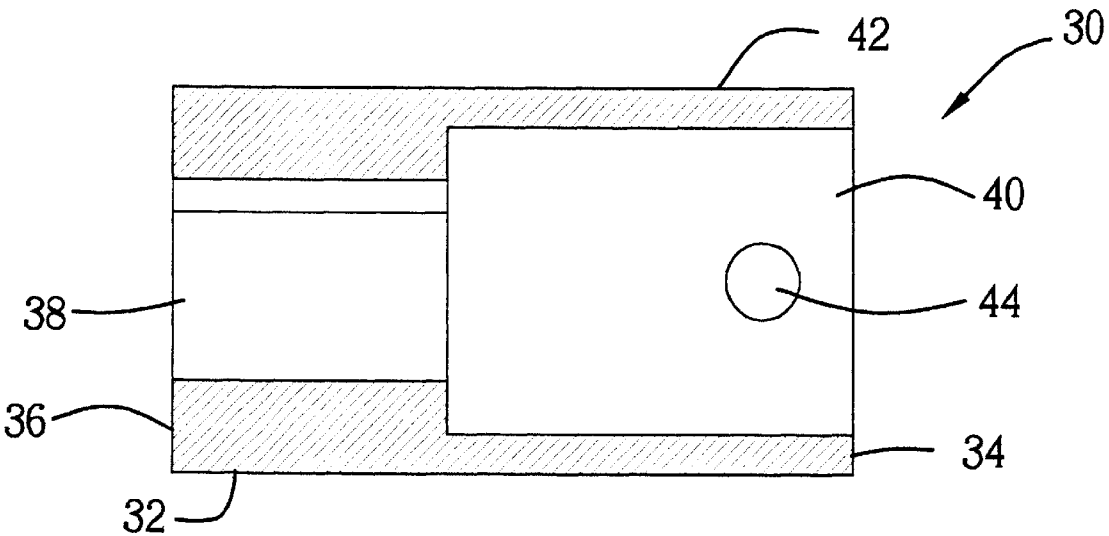
FIG. 3 is a schematic cross-sectional view taken along line 3—3 of the present invention.
Figure 4:
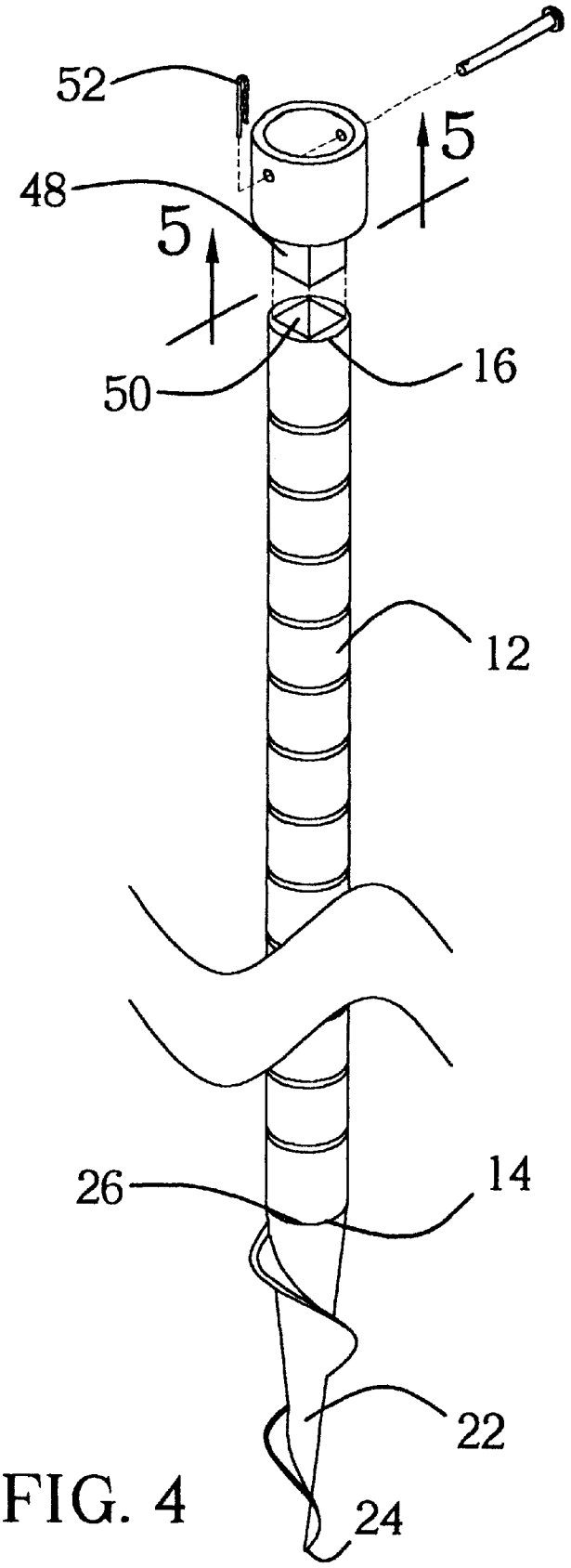
FIG. 4 is a schematic perspective view of a rounded post of the present invention.

With reference now to the drawings, and in particular to FIGS. 1 through 5 thereof, a new easily installable fence post embodying the principles and concepts of the present invention and generally designated by the reference numeral 10 will be described.

As best illustrated in FIGS. 1 through 5, the easily installable fence post 10 generally comprises an elongated member 12 having a first end 14 and the second end 16. The elongated member 12 has a generally T-shaped cross-section taken perpendicular to a longitudinal axis of the elongated member such that three edges 18 of the elongated member are defined. Each of the edges 18 has a plurality of the nubs 20 integrally coupled thereto and extending away therefrom. The elongated member 12 has a length generally between three feet and seven feet. The nubs 20 are used for wrapping fence wire about the elongated member.

An auger bit portion 22 for extending into a ground surface has a pointed end 24 a blunt end 26. The blunt end 26 is integrally coupled to the first end 14 of the elongated member 12 such that the auger bit 22 has a longitudinal axis that is generally coaxial with the longitudinal axis of the elongated member 12.

Figure 5:
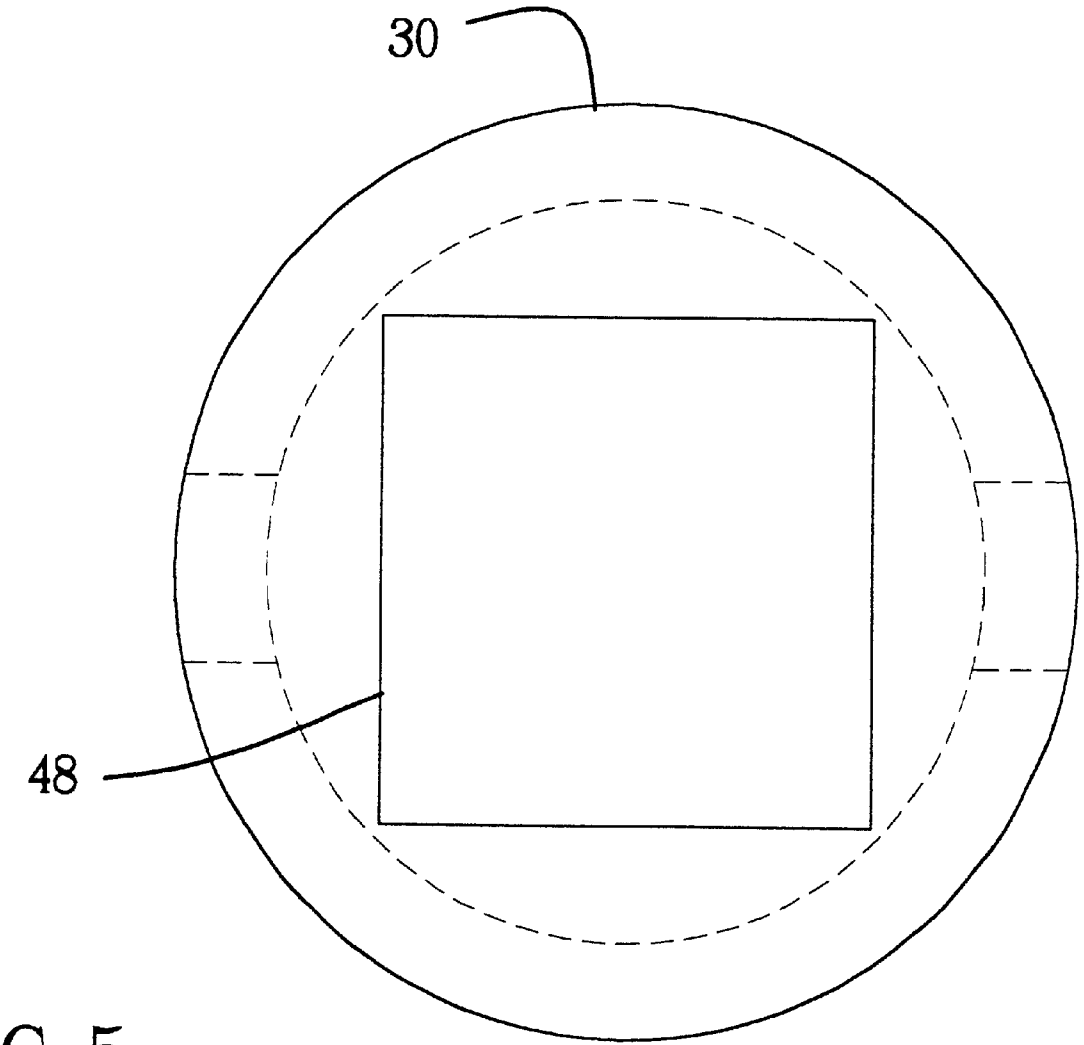
FIG. 5 is a schematic top view of a coupling member for the rounded post of the present invention.

A coupling member 30 removably couples the elongated member 12 to a shaft. The shaft is a conventional shaft extending from a gearbox mounted on tractors and used for drilling purposes. The shaft has a hole therethrough for receiving a pin. The coupling member 30 comprises a cylinder 32 with a top side 34 and a bottom side 36. The bottom side 36 of the coupling member 30 has a hole 38 extending therein has a T-shape for removably receiving the second end 16 of the elongated member 12. The top side 34 has cylindrical opening 40 extending therein for removably receiving the shaft. A peripheral wall 42 of the coupling member 30 has a pair of diametrically opposed apertures 44 therein. The apertures 44 extend into the cylindrical opening 40. A pin 46 is extendable through the apertures 44 and the shaft. For rounded elongated members 12, as shown in FIG. 5, the bottom side 36 of the coupling member 30 comprises a block 48 positionable in a well 50 extending into the second end 16 of the elongated member 12.

In use, the device 12 is positioned where a fence post is needed. The coupling member 30 is coupled to the second end of the elongated member by extending the second end into the coupling member. The pin 46 is placed through the coupling member and through the shaft. A clip 52 is extended through the pin to hold in place. The shaft is turned which in turn rotated the elongated member like a drill bit so that it burrows into the ground.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A readily installable fencing post, said post being removably couplable to a shaft for rotating said post, comprising:

an elongated member having a first end and a second end, said elongated member having a generally T-shaped cross-section taken perpendicular to a longitudinal axis of said elongated member such that three edges of said elongated member are defined, each of said edges of said elongated member having a plurality of nubs integrally coupled thereto and extending away therefrom; and an auger bit portion for extending into a ground surface, said auger bit portion having a pointed end and a blunt end, said blunt end being integrally coupled to said first end of said elongated member such that said auger bit has a longitudinal axis being generally coaxial with a longitudinal axis of said elongated member.

2. The readily installable fencing post as in claim 1, further including a coupling member for removably coupling said elongated member to the shaft, said coupling member comprising a cylinder with a top side and a bottom side, said bottom side of said coupling member being removably insertable into said second end of said elongated member, said top side of said coupling member being removably couplable to said shaft.

3. The readily installable fencing post as in claim 1, further including a coupling member for removably coupling said elongated member to the shaft, said coupling member comprising a cylinder with a top side and a bottom side, said bottom side of said coupling member having a hole extending therein having a T-shape for removably receiving said second end of said elongated member, said top side having cylindrical opening extending therein for removably receiving said shaft, a peripheral wall of said coupling member having a pair of diametrically opposed apertures therein, said apertures extending into said cylindrical opening, a pin being extendable through said apertures and said shaft.

4. A readily installable fencing post, said post being removably couplable to a shaft for rotating said post, comprising:

an elongated member having a first end and a second end, said elongated member having a generally T-shaped cross-section taken perpendicular to a longitudinal axis of said elongated member such that three edges of said elongated member are defined, each of said edges having a plurality of nubs integrally coupled thereto and extending away therefrom, said elongated member having a length generally between three feet and seven feet;

an auger bit portion for extending into a ground surface, said auger bit portion having a pointed end and a blunt end, said blunt end being integrally coupled to said first end of said elongated member such that said auger bit has a longitudinal axis being generally coaxial with said longitudinal axis of said elongated member; and a coupling member for removably coupling said elongated member to the shaft, said coupling member comprising a cylinder with a top side and a bottom side, said bottom side of said coupling member having a hole extending therein having a T-shape for removably receiving said second end of said elongated member, said top side having cylindrical opening extending therein for removably receiving said shaft, a peripheral wall of said coupling member having a pair of diametrically opposed apertures therein, said apertures extending into said cylindrical opening, a pin being extendable through said apertures and said shaft.

* * * * *